US006302063B1

(12) United States Patent
Schimmeyer

(10) Patent No.: US 6,302,063 B1
(45) Date of Patent: Oct. 16, 2001

(54) WATER HEATER HEAT TRAP WITH PRESSURE RELIEF ASSEMBLY

(76) Inventor: Werner Schimmeyer, 8937 Acorn Pl., Santa Rosa, CA (US) 95409

( * ) Notice: Subject to any disclaimer, the term of this patent is extended or adjusted under 35 U.S.C. 154(b) by 0 days.

(21) Appl. No.: 09/781,029

(22) Filed: Feb. 9, 2001

(51) Int. Cl.[7] ..... F22B 5/00

(52) U.S. Cl. ..... 122/14.3; 122/14.31; 137/493.9; 137/539

(58) Field of Search ..... 122/14.3, 14.31; 137/493.9, 493, 539

(56) References Cited

U.S. PATENT DOCUMENTS

| | | | |
|---|---|---|---|
| 4,286,573 | 9/1981 | Nickel | 126/362 |
| 4,964,394 | 10/1990 | Threatt | 126/361 |
| 5,277,171 | 1/1994 | Lannes | 126/362 |
| 5,577,491 | 11/1996 | Lewis | 126/362 |
| 5,671,771 | 9/1997 | Brandel | 137/337 |

*Primary Examiner*—Jiping Lu
(74) *Attorney, Agent, or Firm*—Walter A. Hackler

(57) ABSTRACT

A heat trap assembly includes a housing adapted for interconnection between a hot water tank and a water line with the housing including an interior flow chamber. A one-way valve is disposed within the chamber for enabling unrestricted water flow only in one direction through the chamber. The valve includes a valve seat fixed within a chamber along one direction and movable in an opposite direction along with a movable sealing member. A spring is provided for urging the sealing member against the valve seat to prevent flow though the chamber in the opposite direction. Water flow in the one direction compresses the spring and dislodges the sealing member from the valve seat. A pressure relief disk is provided and disposed between the valve seat and the end of the chamber. The pressure relief disk compresses under a selected water pressure exerted in the opposite direction for enabling flow in the opposite direction at pressures greater than a selected water pressure within a hot water tank.

16 Claims, 2 Drawing Sheets

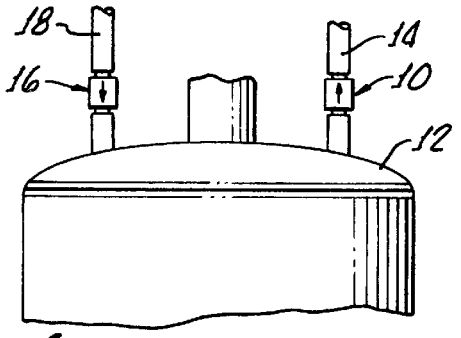
FIG. 1.
FIG. 2.
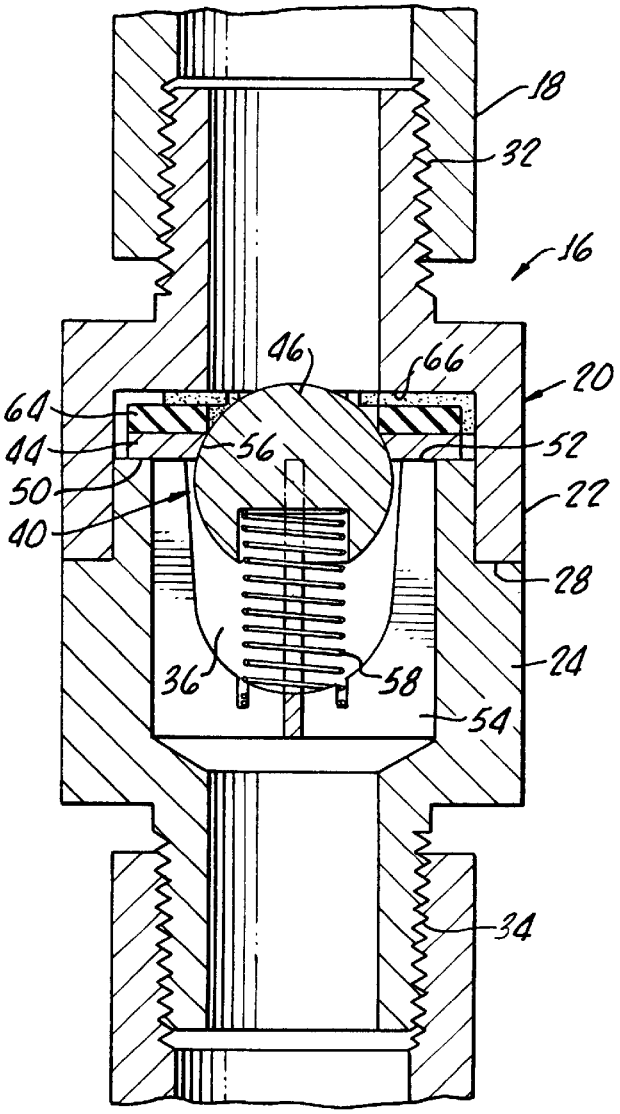
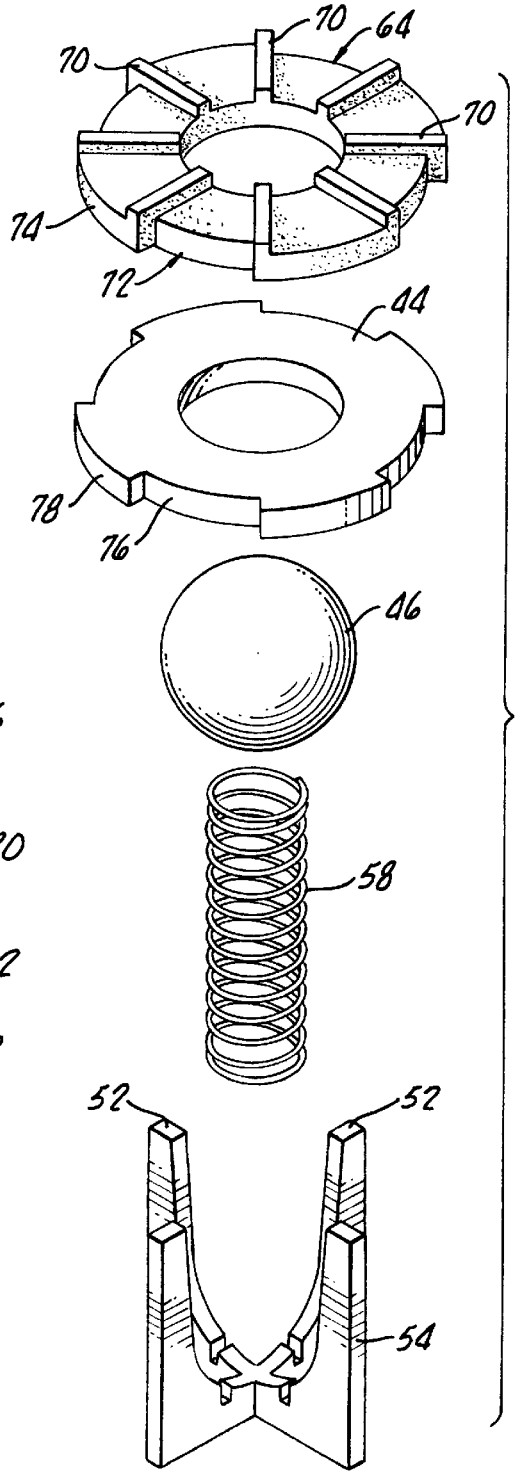
FIG. 3.

WATER HEATER HEAT TRAP WITH PRESSURE RELIEF ASSEMBLY

The present invention is generally directed to a heat trap for preventing heat loss in a water heater and storage system, and is more specifically directed to a non-restrictive heat trap assembly which provides for pressure relief.

In a typical residential or commercial water heater system, cool water is introduced into a heated storage tank through an inlet port, and hot water is removed from the storage tank through an outlet port. The ports are connected to plumbing lines leading from a municipal water source and to various plumbing fixtures within the residence or structure.

Many devices have been proposed and developed with an aim of increasing energy efficiency and reducing energy loss associated with water heater systems. Insulating elements, for example thermally insulating jackets wrapped about a water heater tank and/or connecting hot water lines provide an inexpensive, simple means of reducing some heat loss.

Unfortunately, significant heat loss can still occur, despite careful insulation of the water heater tank and pipes. This is because a significant amount of heat loss is attributable to thermal convection currents within the pipes themselves, for example at the tank inlet and outlet ports. These convention currents do not refer to the conduction of water into and/or out of the tank, but rather to heat transfer from hot water in the tank into cooler water at the ports. Thus, even when the water system is in a standby mode (i.e. water is not being introduced to or removed from the tank) a significant amount of heat loss will continuously occur despite the use of external insulation means.

Various heat traps have been proposed as a means of isolating the hot water in the tank from standing water in the connecting pipes during periods of standby. One such assembly is described in U.S. Pat. No. 4,286,573 to Nickel, issued on Sep. 1, 1981 and entitled "Water Heater Heat Trap Assembly", and incorporated herein in its entirety by this specific reference. The Nickel patent discloses a heat trap assembly having a sealing member located against a valve seat within the piping of the cold water inlet, and a second sealing member located against a valve seat within the piping of the hot water outlet. The sealing members may be plastic or metal balls sized to seal the inlet and outlet valves. The sealing ball in the inlet piping is a low density ball that will float in water. The sealing ball in the outlet piping is a higher density ball that will sink in water.

Heat trap assemblies similar to the assembly disclosed by Nickel have been commercially available for a number of years. Unfortunately, however, sales of these generally ineffective devices have not been highly successful. Consumers have complained that the plumbing lines had become disturbingly noisy after installation of a heat trap assembly in the plumbing lines. Even small movements of the sealing ball within the piping can be audible, and are frequently heard as a tapping or rattling sound throughout the home. Thus, many consumers have had the heat trap assemblies removed after installation. In addition, available heat trap assemblies are made of galvanized steel, and conduct heat rather than provide insulation.

U.S. Pat. No. 4,964,394, issued on Oct. 23, 1990 to Threatt discloses a Water Heater with Heat Trap in Dip Tube. In general, the Threatt invention utilizes a heat trap in which the travel stroke of the sealing ball is located within a tube that extends into the storage tank itself. Threatt states that by locating the travel stroke of the ball entirely within the storage tank, noise caused by movement of the ball is reduced when compared to prior systems.

A reduction in water pressure is another drawback that has been associated with the installation of conventional heat trap assemblies. When hot water is demanded at a remote fixture, the sealing element is pushed off of the valve seat, allowing water to flow around the element and through the outlet port. However, the sealing element may act as a restriction within the water flow path, thereby decreasing water pressure at the fixture. Similarly, the sealing element within the inlet port acts as a restriction that may slow down tank replenishment.

Another important consideration is the need to provide pressure relief to the hot water tank. As is well known, water expands slightly when heated and when contained in a sealed tank, increases the water pressure within the tank. Hence, for safety purposes it is important to provide for temporary pressure relief. This pressure relief is distinct from pressure relief due to extreme pressure buildup within the tank due to malfunction. Such extreme pressure relief is typically provided in a water heater tank by a relief valve for enabling efflux exterior to the tank.

The present invention provides an improved heat trap assembly which addresses these problems, and other problems associated with the use of conventional heat trap assemblies which will later become apparent. As will be discussed in detail hereinafter, the present heat trap assembly is designed to provide quiet, safe and efficient heat trap assembly which can be easily installed in a commercial or residential facility to reduce energy consumption of a water heater tank while at the same time functioning a pressure relief element.

SUMMARY OF THE INVENTION

A heat trap assembly in accordance with the present invention, generally includes a housing adapted for interconnection between a water heater tank and a water line with the housing including an interior flow chamber which is in fluid communication with the water heater tank and the water line.

A one-way valve is disposed in the chamber for enabling unrestricted water flow only in one direction, that through the chamber. The valve generally includes a valve seat fixed within the chamber along the one direction and movable in an opposite direction along with a moveable sealing member.

A spring is disposed within the chamber for urging the sealing member against the valve seat to prevent flow through the chamber in an opposite direction. Water flow in the one direction, compresses the spring and dislodges the sealing member from the valve seat.

A pressure relief disk is provided and disposed between the valve seat and an end of the chamber. The pressure relief disk compresses under a selected water pressure exerted in the opposite direction for enabling water flow in the opposite direction at pressures greater than the selected water pressure.

In this manner, the valve isolates hot water in the water heater tank from standing water within the water line. Thus, migration of cold water into the tank and hot water out of the tank, is prevented during periods of time when water is not drawn from the hot water tank.

More particularly, the valve seat includes a notched perimeter for enabling water flow therepast upon compression of the pressure relief disk. The pressure relief disk also includes a notched perimeter for enabling water flow therepast upon compression of the pressure relief disk.

The pressure relief disk includes at least one compressible element disposed on one side of the pressure relief disk and preferably a plurality of compressible elements are provided in the form of spaced apart radial ribs.

The chamber has a cross-sectional area available for water flow greater than the cross-sectional flow of the water line, and accordingly, the heat trap assembly and valve do not provide any restriction to water flow in the one direction.

To further isolate the water line from by way of electrolysis, the housing is preferably formed from a non-metallic material.

BRIEF DESCRIPTION OF THE DRAWINGS

The features and advantages of the present invention may be more thoroughly understood and appreciated with reference to the following in detail description when considered in conjunction with the accompanying drawings of which:

FIG. 1 is a plan view of an upper portion of a typical hot water heater tank showing a non-restrictive heat trap assembly in accordance with the present invention installed between the tank and a cold water inlet line along with a second heat trap assembly in accordance with the present invention installed between the tank and a hot water outlet line;

FIG. 2 is a cross-sectional view of the heat trap assembly in accordance the present invention generally showing a housing, a one-way valve disposed within a housing chamber, a spring for urging a sealing member against a valve seat and a pressure relief disk disposed between the valve seat and the end of the chamber;

FIG. 3 is an exploded perspective view showing the pressure relief disk, valve seat, sealing member, spring and supporting element;

DETAILED DESCRIPTION

Figure 4:
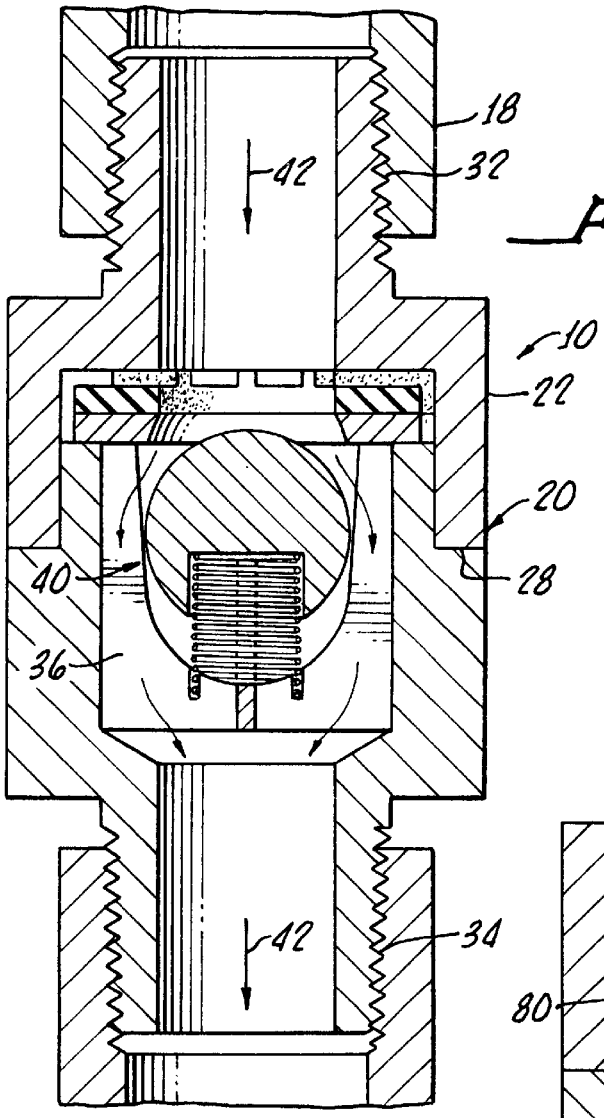
FIG. 4 is a cross-sectional view similar to that shown in FIG. 2 illustrating unrestricted flow of water through the heat trap assembly in one direction.

With reference to FIG. 1, there is shown a heat trap assembly 10 interconnected between a hot water tank 12 and a hot water line 14 as well as a heat trap assembly 16 interconnected between hot water tank 12 and a cold water line 18. It should be appreciated that the assemblies 10, 16 are identical, and accordingly, the heat trap assemblies 10, 16 may be interchanged or used in combination for isolating water, not shown, within the tank 12 from both the hot water line 14 and the cold water line 18, when hot water is not withdrawn from the tank 12.

As shown in FIG. 2, the heat trap assembly 16 includes a housing 20 which may include a top portion 22 and a bottom portion 24 ultrasonically welded, or otherwise sealed together along a seam 28. The manufacture of the housing 20 in two portions, 22, 24 facilitates production of the assembly 10.

Preferably, the housing 20 is formed from a non-metallic material, such as, for example, CPVC and this feature prevents electrolysis from occurring between the hot water lines 14, 18 and the tank 12. The housing 20 is adapted for interconnection between the 14 and tank 12 by threads 32, 34 in top portion 22 and bottom portion 24, receptively, of the housing 20.

The housing 20 includes a chamber 36 which has a greater cross-section than either of the water lines 14, 18 and provides for unrestricted water flow through the housing upon opening of a valve 40 which enables water flow only in one direction as indicated by the arrows 42, see FIG. 4, upon opening of the valve 40.

The one-way valve 40 includes a valve seat 44 and a moveable sealing member, or ball 46. The valve seat 44 is fixed along the flow direction 42 within the chamber 36 against a shoulder 50 and ends 52 of a supporting member, or cage 54, see also FIG. 3. The cage 50 may be a separate element or it may be formed integrally with the housing 20.

The ball 46 is urged against the valve seat 44 by a spring 58 and sealably engages an arcuate surface 56. The valve seat 44, ball 46 and cage 54, may be formed from any suitable material, such as, for example CPVC. Importantly, the ball 46 does not float within the chamber 36 as in many prior art devices. Rather, the spring 58 provides a positive pressure engagement and seal between the ball 46 and the valve seat 44, thus insuring isolation of water within the tank 12 and the line 18, when water flows in the direction of arrow 42, shown in FIG. 4.

Figure 5:
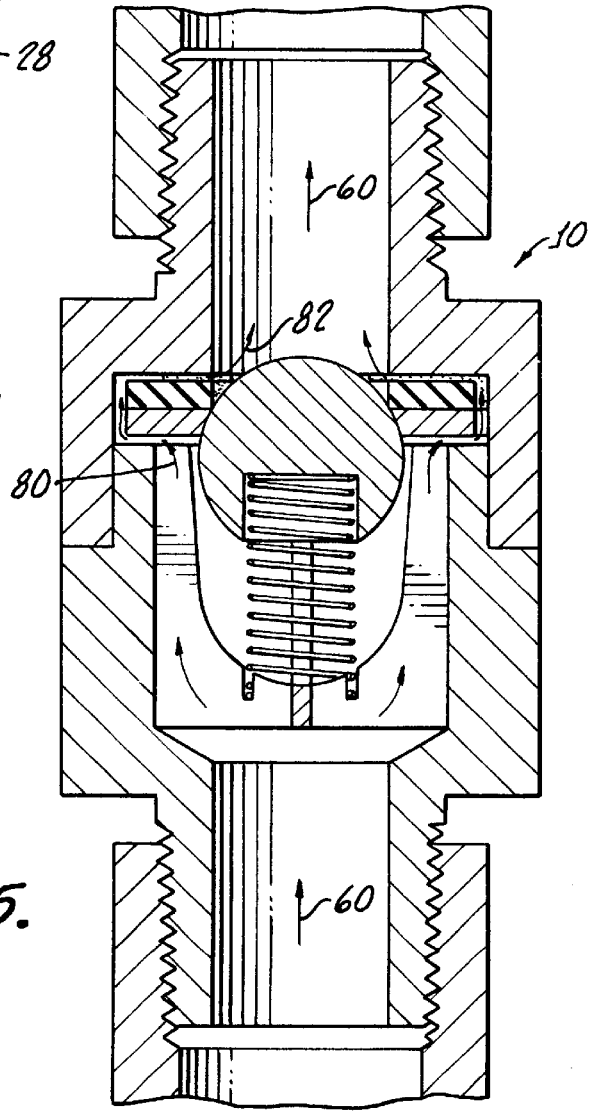
FIG. 5 is a cross-sectional view of the heat trap assembly similar to FIGS. 2 and 4 showing limited water flow in an opposite direction through the chamber for providing pressure relief.

In order to provide pressure relief and minor flow of water in a direction indicated by the arrow 60 in FIG. 5, a pressure relief disk 64 is provided and disposed between the valve seat 44 and an end 66 of the chamber 36.

As most clearly shown in FIG. 3, the pressure relief disk 64 includes a plurality of upstanding ribs 70 formed therein which facilitate compression of the disk 64 upon buildup of water pressure within the tank 12, thus enabling water flow in the direction of arrow 60 as shown in FIG. 5.

While ribs 70 are shown, it should be appreciated that other means may be provided to enable a compression or squeezing of the disk 64. In fact, the disk 64 may be formed from a compressible material without the ribs 70 as long as compression occurs at a selected pressure. Such materials being selected and, with or without ribs 70 determined empirically. However, the use of ribs provides for better control of compressibility.

Notches 72 formed in a perimeter of the disk 64 and notches 76 formed in a perimeter 78 of the valve seat 44 enable water flow therepast as indicated by the arrows 80, 82 upon compression of the disk 64 as shown in FIG. 5.

Although there has been hereinabove described a heat trap assembly in accordance with the present invention, for the purpose of illustrating the manner to which the invention could be used to advantage, it should be appreciated that the invention is not limited thereto. Accordingly, any and all modification, variations or equivalent arrangements which may occur to those skilled in the art, should be considered to be within the scope of the invention as defined by the appended claims.

What is claimed is:

1. A heat trap assembly for installation between a water heater tank and a water line comprising:

a housing adapted for interconnection between said water heater tank and said water line, said housing including an interior flow chamber in fluid communication with said water heater tank and said water line;

a one-way valve disposed in the chamber for enabling unrestricted water flow only in one direction through the chamber, the valve comprising a valve seat and a moveable sealing member;

a spring, disposed within the chamber, for urging the sealing member against said valve seat to prevent flow through the chamber in an opposite direction, water flow in the one direction compressing said spring and dislodging the sealing member from said valve seat; and a pressure relief disk disposed between said valve seat and an end of the chamber, said pressure relief disk compressing under a selected water pressure exerted in said opposite direction for enabling water flow in said opposite direction at pressures greater than said selected water pressure.

2. The heat trap assembly according to claim 1 wherein said valve seat includes a notched perimeter for enabling water flow therepast upon compression of said pressure relief disk.

3. The heat trap assembly according to claim 2 wherein said pressure relief disk includes a notched perimeter for enabling water flow therepast upon compression of said pressure relief disk.

4. The heat trap assembly according to claim 3 wherein said pressure relief disk includes at least one compressible element disposed on one side of said pressure relief disk.

5. The heat trap assembly according to claim 4 wherein said pressure relief disk includes a plurality of compressible elements.

6. The heat trap assembly according to claim 5 wherein said pressure relief disk compressible elements comprise a plurality of spaced apart radial ribs.

7. The heat trap according to claim 6 wherein the chamber has a cross-sectional area available for water flow greater than a cross-section of said water line.

8. The heat trap according to claim 7 wherein said housing is formed from a non-metallic material to prevent electrolysis between said water line and said water heater tank.

9. A heat trap assembly for installation between a water heater tank and a water line comprising:

a housing adapted for interconnection between said water heater tank and said water line, said housing including an interior flow chamber in fluid communication with said water heater tank and said water line;

a valve disposed in the chamber for isolating hot water in said water heater tank from standing water within said water line, the valve comprising a valve seat and a moveable sealing member;

a spring, disposed within the chamber, for urging the sealing member against said valve seat to prevent flow through the chamber in one direction, water flow in an opposite direction compressing said spring and dislodging the sealing member from said valve seat; and a pressure relief disk disposed between said valve seat and an end of the chamber, said pressure relief disk compressing under a selected water pressure exerted in said one direction for enabling water flow in said one direction at pressures greater than said selected water pressure.

10. The heat trap assembly according to claim 9 wherein said valve seat includes a notched perimeter for enabling water flow therepast upon compression of said pressure relief disk.

11. The heat trap assembly according to claim 10 wherein said pressure relief disk includes a notched perimeter for enabling water flow therepast upon compression of said pressure relief disk.

12. The heat trap assembly according to claim 11 wherein said pressure relief disk includes at least one compressible element disposed on one side of said pressure relief disk.

13. The heat trap assembly according to claim 12 wherein said pressure relief disk includes a plurality of compressible elements.

14. The heat trap assembly according to claim 13 wherein said pressure relief disk, compressible elements comprise a plurality of spaced apart radial ribs.

15. The heat trap according to claim 14 wherein the chamber has a cross-sectional area available for water flow greater than a cross-section of said water line.

16. The heat trap according to claim 15 wherein said housing is formed or molded from a non-metallic material to prevent electrolysis between said water line and said water heater tank.

* * * * *